US011505950B2

(12) United States Patent
Su

(10) Patent No.: US 11,505,950 B2
(45) Date of Patent: Nov. 22, 2022

(54) TILES, FLOORS, AND METHODS AND PROCESSES RELATED THERETO

(71) Applicant: Honyao Newtech Co., Ltd., Tainan (TW)

(72) Inventor: Guo-Ren Su, Tainan (TW)

(73) Assignees: INCSTORES LLC, Mesa, AZ (US); HONYAO NEWTECH CO., LTD., Tainan (TW)

( * ) Notice: Subject to any disclaimer, the term of this patent is extended or adjusted under 35 U.S.C. 154(b) by 0 days.

(21) Appl. No.: 16/797,407

(22) Filed: Feb. 21, 2020

(65) Prior Publication Data

US 2020/0270877 A1 Aug. 27, 2020

(30) Foreign Application Priority Data

Feb. 22, 2019 (TW) ..... 108202251

(51) Int. Cl.
*E04F 15/02* (2006.01)
*E04F 15/10* (2006.01)

(52) U.S. Cl.
CPC .. *E04F 15/02038* (2013.01); *E04F 15/02172* (2013.01); *E04F 15/105* (2013.01); *E04F 15/107* (2013.01); *E04F 2201/0138* (2013.01); *E04F 2201/021* (2013.01); *E04F 2201/043* (2013.01); *E04F 2290/02* (2013.01)

(58) Field of Classification Search
CPC ..... E04F 15/02038; E04F 15/02172; E04F 2290/02; E04F 2201/021; E04F 2201/043; E04F 2201/0138; E04F 15/105; E04F 15/107; E04F 15/02194; E04F 2201/095
USPC ... 52/177, 386, 387, 390, 385, 592.1, 403.1, 52/591.1, 384
See application file for complete search history.

(56) References Cited

U.S. PATENT DOCUMENTS 4,930,286 A * 6/1990 Kotler ..... E04F 15/105 428/44
5,323,575 A * 6/1994 Yeh ..... E04F 21/1844 52/177
5,628,160 A * 5/1997 Kung ..... E04F 15/105 52/591.1
5,787,654 A * 8/1998 Drost ..... E01C 5/20 52/177
6,352,757 B1 * 3/2002 Kessler ..... A47L 23/24 15/215
7,487,622 B2 * 2/2009 Wang ..... E04F 13/0862 52/177
7,698,859 B2 * 4/2010 Sansano Marti ..... E04F 15/087 52/177
7,748,177 B2 * 7/2010 Jenkins ..... E01C 5/20 52/177
7,793,471 B2 * 9/2010 Hill ..... B32B 9/045 52/177

(Continued)

FOREIGN PATENT DOCUMENTS

JP 05331984 A * 12/1993

*Primary Examiner* — Brent W Herring
(74) *Attorney, Agent, or Firm* — Pequignot + Myers; Matthew A. Pequignot

(57) ABSTRACT

Two-piece tiles and/or floors comprised of a plurality of such two-piece tiles. In other embodiments, methods and/or processes for manufacturing or assembling such two-piece tiles, and/or to methods of assembling floors comprised of such tiles.

25 Claims, 12 Drawing Sheets

(56) References Cited

U.S. PATENT DOCUMENTS

| | | | | |
|---|---|---|---|---|
| 8,186,116 | B2 * | 5/2012 | Anderson | E04F 15/105 52/392 |
| 8,266,857 | B2 * | 9/2012 | David | E04F 15/087 52/385 |
| 8,282,310 | B2 * | 10/2012 | White | E01C 3/06 404/18 |
| 8,407,951 | B2 * | 4/2013 | Haney | E01C 5/20 52/177 |
| 8,539,727 | B2 * | 9/2013 | Lui | E04F 15/02 52/384 |
| 9,771,722 | B2 * | 9/2017 | Hurson | B32B 37/1027 |
| 9,863,155 | B2 * | 1/2018 | Cerny | E04F 15/02038 |
| 9,944,017 | B2 * | 4/2018 | Neill | E04F 15/105 |
| 2004/0226242 | A1 * | 11/2004 | Moller, Jr. | E04F 15/02172 52/578 |
| 2005/0108968 | A1 * | 5/2005 | Forster | E04F 15/105 52/578 |
| 2017/0081862 | A1 * | 3/2017 | Gu Bilmez | B29C 45/16 |

* cited by examiner

TILES, FLOORS, AND METHODS AND PROCESSES RELATED THERETO

RELATED APPLICATION DATA

This application claims priority to Taiwan Patent Application No. TW 108202251, filed on Feb. 22, 2019, entitled MODULAR PLASTIC FLOOR. The entirety of such application is hereby incorporated by reference.

FIELD OF THE INVENTION

The present invention relates to two-piece tiles and/or floors comprised of a plurality of such two-piece tiles. In other embodiments, this invention relates to methods and/or processes for manufacturing or assembling such two-piece tiles, and/or to methods of assembling floors comprised of such tiles.

BACKGROUND OF THE INVENTION

Foam and plastic floor tiles, useful for end-user installation, have been known in the art for decades. For example, U.S. Pat. No. 6,588,167, issued to Kuo Chi Chang, teaches floor tiles having a plurality of teeth, and a plurality of tooth shaped grooves, so that the tiles can be assembled together using dovetail-type, interlocking tile-to-tile connections. Configured as such, the interconnectible tiles taught in Chang can be sold as individual tiles, or sets of tiles, which can be assembled at home (or in a business environment) by an unskilled end-user.

"Unskilled", in this context, means an end-user without specific construction, carpentry, or similar trade experience. Indeed, such tile types can be assembled to other tiles by anyone with sufficient manual dexterity to install a simple puzzle piece. Consequently, a home owner can purchase tiles, such as the Chang-style tiles, in bulk and then assemble the tiles to fill spaces such as children's play areas or workout rooms. Lending to their ease of use, if a small or large room floor is going to be installed with such tiles, the number of tiles purchased is simply selected to match the desired floor installation size. For example, for tiles sold in 12" square sizes, 100 tiles would be purchased to fill a 100 square foot floor space.

As an additional benefit to the tiles disclosed in Chang, the tiles are disclosed as having different colors on different sides. Accordingly, individual tiles can be flipped over (alone or in groups) to change floor colors or color pattern characteristics. Given their ease of use and versatility, the popularity of tiles, like the Chang-style tiles, has grown tremendously over the years.

Although mats, such as those disclosed in Chang, have enjoyed significant popularity, such mats suffer numerous drawbacks, including related to their typically foam construction, solid structure, and/or lack of tailorability. For example, Chang-type mats are typically made of foamable materials such as ethylene vinyl acetate ("EVA"), which is not suitably durable for certain applications, such installations in automobile garages. Also, because the mats are solid-construction, the amount of material required to manufacture the mats is correspondingly high. Moreover, even though the mats disclosed in Chang are "dual color", the colors of the mats are not changeable or tailorable because the differently colored layers of the Chang mats are one-piece construction. Similarly, the textures or ornamental surfaces of the mats are not tailorable.

In recognition of such drawbacks, it is, in certain embodiments, a purpose of the herein described inventions to supply improvements to one or more aspects of the state of the art. It is also a purpose of the herein described inventions to address other drawbacks and/or other desires for improvements in the art, whether or not currently known, which will become more apparent to the skilled artisan once given the present disclosure.

SUMMARY OF THE INVENTION

Generally speaking, the inventions described herein relate to floor tiles, and floors made from such tiles, which have configurations or functions which have been heretofore unknown in the art. Other inventions described herein relate to methods and/or processes for manufacturing or assembling such tiles, and/or to methods of assembling floors comprised of such tiles. In certain preferred embodiments of the disclosed inventions, two-piece tiles and/or floors comprised of a plurality of such two-piece tiles are provided. In other embodiments, methods and/or processes for manufacturing or assembling such two-piece tiles, and/or methods of assembling floors comprised of such two-piece tiles are provided.

In certain exemplar embodiments, the tiles provided are two-piece tiles formed from a structurally supportive tile base portion (e.g., referred to as a "base board" elsewhere herein) which is installable to a generally planar top tile portion (e.g., referred to as a "stepping portion" elsewhere herein) which serves as the top surface of the tile (or top surface of a floor made from such tiles).

Optionally, the top tile portion may be a different color than the bottom base portion. Also, optionally, in addition to permitting top/bottom tile portion color selection, the top and bottom (or base) tile portions can be individually tailored to have desired or needed mechanical or physical characteristics and then top and bottom tile portions assembled together accordingly. That is, the top and bottom tile portions can be tailored to have the same, or different, physical and/or mechanical characteristics depending on the desired two-piece tile attributes (for example, a tile with a rigid walking surface but cushioned base may be desired). Likewise, the treads that are formed into the bottom base portion may be formed from the same or a different material than the material used to form the bottom base portion. For example, rubber treads may be desired while maintaining a rigid (e.g., hard plastic) skeletal structure in the remainder of the base portion.

In some preferred (but still optional) embodiments, the top tile surface can be temporarily assembled to the base tile portion and then later unassembled, so that the top tile portion may be removed. In such embodiments which utilize temporary top/base tile assembly configurations, the top tile portion may be removably installable on the bottom base portion. Meaning, in these example (but non-limiting) embodiments, the two pieces of the tile can be assembled together to form a two piece tile, but thereafter, the two pieces may be disassembled from one another so that one or the other of the pieces may be replaced or repaired (for example).

Alternatively, in other (also optional) embodiments, when the top tile portion is assembled to the bottom base tile portion, the assembly is essentially permanent in the sense that the top and bottom pieces of such embodiments of the two-piece tile cannot be separated from one another without destructive forces being applied. Further details pertaining to such temporary and permanent assembly variants are, of course, provided in the DETAILED DESCRIPTION section below.

In either of the temporary or permanent assembly embodiments, tailorability improvements are obtained and/or inventory and/or storage issues are solved or ameliorated. For example:

base tile portions may be mass produced in a standard color such as black (or any other suitable base color) and stored pending orders for specific colors of tiles. Upon receipt of specific color orders, the top tile portions can be manufactured to requested specifications and thereafter assembled to the pre-made base tile portions. Because the base portions are pre-made, the time between a customer order and a product delivery can be shortened;

by eliminating the need to pre-manufacture the top tile portion, inventory costs can be reduced. This is because manufacture of the top tile portions can be delayed until receipt of client orders, while still gaining the time-to-delivery benefits of storing tile base portions. Accordingly, this benefit is obtained by the herein disclosed embodiments regardless of whether the top and bottom tile portions are assembled together permanently or on a temporary basis;

if a customer desires a color change of their already installed flooring, utilizing the herein disclosed embodiments such customer can order tile top portion replacements in a different color. By way of more specific example, if a customer already owns an installed blue tile floor, such customer can 1) order yellow tile top portion replacements, 2) remove the existing blue top tile portions, 3) and install the yellow tile top portions to change the color of the floor from blue to yellow;

if a customer desires a surface texture change of their already installed flooring, utilizing the herein disclosed embodiments such customer can order tile top portion replacements having a different surface texture (e.g., stepping surface). By way of more specific example, if a customer already owns an installed tile floor having a smooth surface texture, such customer can 1) order tile top portion replacements with non-smooth surface textures (e.g., with grain, treads, channels, cross-hatching, concave or convex regions, surface ornamentation, apertures, drain holes, etc.), 2) remove the existing smooth top tile portions, 3) and install the replacement tile top portions to change the surface texture of the floor to the newly selected texture (or vice versa);

if a customer is satisfied with the color and/or surface characteristics of their tile floor, but desire a different base portion, 1) new base tile portions may also be ordered, 2) the existing base tile portions disassembled from the desirable top tile portion, and 3) the replacement base portions installed to the retained desirable top tile portions. By way of more specific (but non-limiting) example, reasons for replacing the bottom/base tile portion could include a need (or desire) for a taller height tile (e.g., by selecting a thicker/taller tile base portion) or a need (or desire) for a stronger or more durable bottom/base tile portion (e.g., such as if moving the tile floor to an automotive garage where the tiles will need to carry thousands of pounds). In yet another example, the bottom tile portion could be replaced because of a need (or desire) for a bottom/base tile portion which has different mechanical characteristics than the existing base tile portion. For example, replacement bases could be ordered which have greater elasticity (e.g., "cushioning") to provide improved walking comfort characteristics to the two-piece tile. In such embodiments, the top tile portion may be selected to be a rigid material—such as a rigid plastic—while the base material is selected to have elastic properties (e.g., thereby obtaining a hybrid two-piece tile configuration). In still other examples, tile base configurations can be selected which include spacing or channels for permitting liquid flow (e.g., while the top tile portion remains raised above the liquid surface), such as for if the tile floor will be installed in areas subject to potential flooding, or other water exposure areas such as showers or bar areas;

if a top or bottom/base tile portion is damaged, the respective damaged tile portion can be independently replaced with a new tile portion, thereby obviating the need to replace the entire tile.

In other exemplar embodiments, the top and bottom tile portions can be tailored structurally and/or mechanically, so that the top and bottom/base tile portions, in combination, form a walking floor surface. Of course, use of the term "walking floor surface" in this context should not be construed to require that the floor surface will be walked on, but only that it is the upward facing floor surface which is presented for walking or riding (in the case of vehicle use) thereupon or the like. In a more specific example of one of these embodiments, the top tile portion may include apertures which permit structural portions of the bottom/base tile portion to protrude through or mate to. In an even more specific example, the bottom/base portion includes tread like structural elements which mate to and protrude through apertures in the top tile portion, when the top and bottom/base tile portions are assembled to one another. In addition to such an embodiment providing a "treaded" surface to supply a safer, non-slip walking (or riding or driving) surface, the interaction of the upwardly protruding structural elements—mated with the apertures of the top tile surface—also provides a better mechanical interlock of the top tile surface to the bottom/base tile portion. In other words, the two-pieces of the two-piece tile are more structurally stable, assembled as such, when exposed to non-normal force angles. As yet an additional ornamental benefit, the protruding treads (or other protruding physical structures) can be selected to have a different color than the top tile portion. In this manner, a multi-color tile appearance is achieved. Similarly, the treads (or other protruding physical structures) can be designed to have other desirable physical or mechanical attributes such as glow-in-the-dark features (so that the glow-in-the-dark treads would be visible in darkness, but not the surrounding planar tile surface) or high durability (e.g., such as with the inclusion of wear resistant particles like aluminum or titanium oxides or silica).

In preferred (but optional) embodiments of the herein disclosed tiles, the tiles include interlocking structures along one or more of the perimeter edges of the tile(s). These interlocking structures are provided so that one tile can be connected to another, preferably so that the edges of the respective tiles abut and so that there are no spaces between adjoining tiles. Accordingly, a continuous floor surface can be assembled by connecting a plurality of tiles together, using interlocking structures provided along all sides of a four-sided tile, to fill an existing room area, for example. The interlocking structures of the tiles, in preferred embodiments, are typically male-protrusions alternated with female-receptacles, so that an adjoining tile, with complementary shaped female/male receptacles/protrusions, can interlock its receptacles/protrusions with the protrusions/receptacles of an opposing/adjoining tile. As disclosed herein and discussed in further detail below, the unique two-piece tiles considered to be a subset of inventions within this application, preferably—but not necessarily—include a unique configuration of interlocking members comprised of U-shaped loop type structures which mate to female receptacle of adjoining tiles. These U-shaped loop connectors, moreover, are also tailorable and may—for example—be extended in length to intentionally supply space between adjoining but connected tiles. Such spaces, when optionally included, can serve as channels or drain structures so that water (or other liquid) which is spilled on a tile floor drains to the surface below. Of course, this is an optional example only and is not intended to limit any specific embodiment of the inventions disclosed herein, unless specifically and expressly designated by the claims. The U-shaped female connector, or U-shaped channel, may also include a deformable riser located proximal thereto that is configured to exert a force on the edge of an adjacent tile, when the tiles are connected to one another. The riser aids in securing the connection and may optionally include an extended tip portion for further securing the tiles to each other. In still other embodiments, the riser may comprise two riser portions which are each deformable and which have an outer dimension nominally greater than the size of the aperture of the U-shaped female connector. Sized as such, the U-shaped female connector fits snugly over the riser portions of an adjacent tile with each riser portion deforming slightly to accommodate such snug fit, thereby also resulting in a friction fit which resists disengagement and providing an suitably secure tile-to-tile connection. Such tile-to-tile connection may also be aided by the inclusion of a tip extension member on at least one riser portion to provide a more secure snap-fit connection to the adjacent tile.

In at least one embodiment, an optional structural feature is included for aiding in the connection, and disconnection, of adjoining tiles to one another. Specifically, a beveled wall structure is utilized in optional embodiments, located proximal male/female interlock connectors, to enable the tiles to be more easily assembled to each other when installing a floor, or disassembled from one other when removing an installed floor.

In certain (optional) embodiments of the invention, the two-piece tiles utilize a bottom/base which is non-solid in configuration. For example, in some of these embodiments, the base in constructed as a skeletal framework bounded by a plurality of vertical walls. In a more specific example, in a tile which is square in configuration, a preferred embodiment of a base structure includes four (substantially) vertical walls forming the generally planar square itself, with a skeletal frame extending in various directions in the space between the vertical side walls of the square. The combination of such skeletal frame and the vertical walls results in a structurally strong and durable base structure, upon which the top tile portion may be assembled. Of course, the precise configuration, including the shape and wall thickness and material selection can be tailored for different tile bottoms/bases, depending on the desired end use of the two-piece tile. As one benefit of utilizing a non-solid tile base, less material is needed to construct the tile base, which saves on product manufacturing costs, increases profits, utilizes less resources, and results in less product waste or recycling burden when the end of the product life cycle is reached. Similarly, utilizing a non-solid tile base portion reduces the overall weight of the floor. It also reduces product shipping weight which can increase profits of the tile seller, if the seller is paying for shipping costs. Or, alternatively, shipping cost savings can be passed along to consumers.

In certain optional embodiments, treads (or similar structures), of one or more configurations, can be located on the top facing portions of the skeletal frame structure (in the embodiments utilizing such a skeletal frame structure). The treads can be configured into any useful shape, such as (for example) a diamond configuration. Alternatively, the treads utilized can be a combination of structural configurations, selected pursuant to the desired end use (or customer order specifications). Further, as discussed elsewhere above, the top tile portion can include apertures having the same general shape of the upwardly protruding treads (affixed to the skeletal frame), so that the treads extend upwards through the apertures and nest snugly within them. This, again as discussed elsewhere above, provides a better mechanical interlock of the top tile surface to the bottom/base tile portion. In such embodiments, it is preferred, but not required, that the upper tread surface be raised above the planar top tile portion surface by at least 1-2 millimeters to provide a friction or gripping surface, to supply non-slip properties to the tile floor.

In still other (but still optional) embodiments, channels or pathways can be provided in the tile base portion for purposes of allowing the hiding of electrical cords for appliances or lighting or stereo equipment, for example (other uses being course contemplated). In such embodiments, the channels or pathways are preferably located and configured so that they align with the channels (or pathways) of adjoining tiles, so as to extend the potential "run" length of an electrical cord (or similar element which is desired to be hidden). Such channels or pathways may be similarly provided for purposes of channeling the flow of water or other liquids, such as for instances in which the tiles (or a floor comprised of the tiles) are installed in a public shower or bar or similar environment where water or other liquids are often present (or spilled). In these or similar embodiments, the wall height—and thus the overall height (or depth) of the tile base portion can be selected based on desired performance characteristics. For example, the tile base can be made taller to decrease floor noise, for occupants of rooms below, if the tile floor is installed on a second (or higher) story. In related embodiments, noise insulation can be added to the hollow spaces of the tile if desired. In still other embodiments, the tile base height can be varied to accommodate expected fluid flow levels or to accommodate the thickness of anticipated electrical cord installations.

In one exemplar embodiment, there is provided: a two-piece tile comprising: a base tile portion having a plurality of structurally supportive skeletal members distributed between walls of a frame, the plurality of structurally supportive skeletal members collectively comprising a skeletal base structure; a plurality of male interlocking members extending from at least one edge the frame of the baseboard; a plurality of female interlocking receptacles located along at least one edge of the frame of the baseboard for receiving male interlocking members of a different, adjacently located two-piece tile; a plurality of tread elements located and distributed atop one or more surfaces of the skeletal base structure; and a top generally planar tile portion having a plurality of apertures which are so sized and spaced so as to match the respective size and spacing pattern of the plurality of tread elements of the base tile portion, such that the top generally planar tile portion is assemblable to the base tile portion with the plurality of tread elements nesting in the plurality of apertures.

In at least one optional floor embodiment, there is provided: a modular plastic floor comprising a plurality of two-piece tiles assembled to one another, each the two-piece tile comprising: a base tile portion having a plurality of structurally supportive skeletal members distributed between the walls of a frame, thereby collectively comprising a skeletal base structure; a plurality of male interlocking members extending from at least one edge the frame of the baseboard; a plurality of female interlocking receptacles located along at least one edge of the frame of the baseboard for receiving male interlocking members of a different, adjacently located two-piece tile; a plurality of tread elements located and distributed atop one or more surfaces of the skeletal base structure; and a top generally planar tile portion having a plurality of apertures which are so sized and spaced so as to match the respective size and spacing pattern of the plurality of tread elements of the base tile portion, such that the top generally planar tile portion is assemblable to the base tile portion with the plurality of tread elements nesting in the plurality of apertures.

In certain (but not all) of the embodiments of the two-piece tiles described herein, the structurally supportive skeletal members comprise a plurality of ribs with empty spaces between ribs. In still other embodiments, the structurally supportive skeletal members comprise a combination of ribs and rings which are distributed longitudinally and latitudinally between the walls of the frame to provide structural support to the tile. For installations which require greater tile strength or durability, increased density and/or thickness of the ribs and rings can be utilized. Materials used to construct the ribs and/or rings can also be tailored to end uses.

Although tile compositions can be tailored to meet certain use specifications, or to comply with customer requests or orders, certain embodiments of the tiles disclosed here are constructed using an injection molding method. In some (non-limiting) embodiments, the methods integrally form a plastic floor having different colors or composite materials. In some of these embodiments, a tile floor is formed by an injection molding method utilizing different colors or materials (e.g., plastic(s)) to achieve the effects of improving the aesthetic appearance while, preferably, reducing the manufacturing cost of the floor.

In still other embodiments, a method is provided wherein a base board having a plurality of ribs, ring ribs, engaging rings, hooks, and tread-like protrusions is formed by an injection molding method. Preferably, a stepping portion (i.e., top tile portion) is thereafter formed by an injection molding method, while also fashioning a plurality of apertures in the surface of the stepping portion, which match the location and patter of the tread-like protrusions of the base board. Although the base board and the stepping portion can be formed of the same materials (e.g., a type of plastic), they may also be formed of different materials, having different properties, to obtain a hybrid floor system. Moreover, different material colors can improve the practicality of use and the aesthetic appearance of the resulting floor.

In yet further embodiments, the provided two-piece tiles include additional pieces or structures. In still other embodiments, floors resulting from assembly of the tiles can include drainage functions, anti-slip properties, have high load carrying capacities, and/or exhibit good light reflection control as a result of the selected configuration, structure, or material of the top and bottom/base tile portions. As another benefit, certain embodiments allow assembled modular floors to be disassembled for cleaning or replacement when a portion of the floor is damaged or stained, thus reducing the material replacement and maintenance costs.

In at least one example method according to the subject inventions, there is provided: a method of making a two-piece tile comprising: injection molding a base tile portion having a plurality of structurally supportive skeletal members distributed between walls of a frame, the plurality of structurally supportive skeletal members collectively comprising a skeletal base structure; forming a plurality of male interlocking members extending from at least one edge the frame of the baseboard; forming a plurality of female interlocking receptacles located along at least one edge of the frame of the baseboard for receiving male interlocking members of a different, adjacently located two-piece tile; forming a plurality of tread elements and locating the plurality of tread elements atop one or more surfaces of the skeletal base structure; injection molding a top generally planar tile portion having a plurality of apertures which are so sized and spaced so as to match the respective size and spacing pattern of the plurality of tread elements of the base tile portion, such that the top generally planar tile portion is assemblable to the base tile portion with the plurality of tread elements nested in the plurality of apertures; and connecting the top generally planar tile portion to the base tile portion.

Certain examples of the invention are now described below with respect to certain non-limiting embodiments thereof as illustrated in the following drawings.

BRIEF DESCRIPTION OF THE DRAWINGS

The drawings submitted herewith, and which form a part of this patent application, each illustrate an embodiment, or one or more components of an embodiment, of a non-limiting example of Applicant's inventive lids. While these drawings depict certain preferred embodiments of Applicant's invention, as well as certain particularly desirable features thereof, they are intended to be examples only and should not be construed to limit the scope of applicants' invention.

DETAILED DESCRIPTION OF CERTAIN EXAMPLE EMBODIMENTS OF THE INVENTION

For a more complete understanding of the present invention, reference is now made to the following description of various illustrative and non-limiting embodiments thereof, taken in conjunction with the accompanying drawings in which like reference numbers indicate like features. These example embodiments, disclosed and discussed below, will assist in a further understanding of the inventions described and claimed herein, but they are not intended to limit the scope of the invention in any way. Although dimensions may be discussed in connection with some embodiments, not all embodiments are intended to be limited to such dimensions, and variants from such dimensions are of course contemplated.

Figure 1:
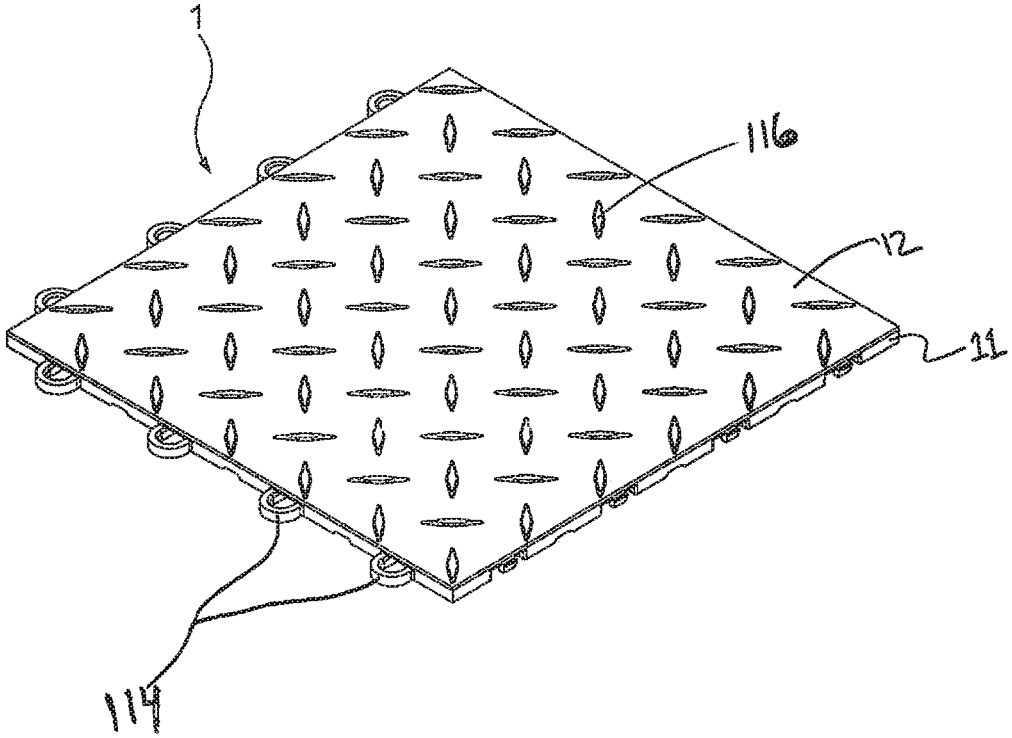
FIG. 1 is a perspective view of one embodiment of a tile according to the subject invention.
Figure 2:
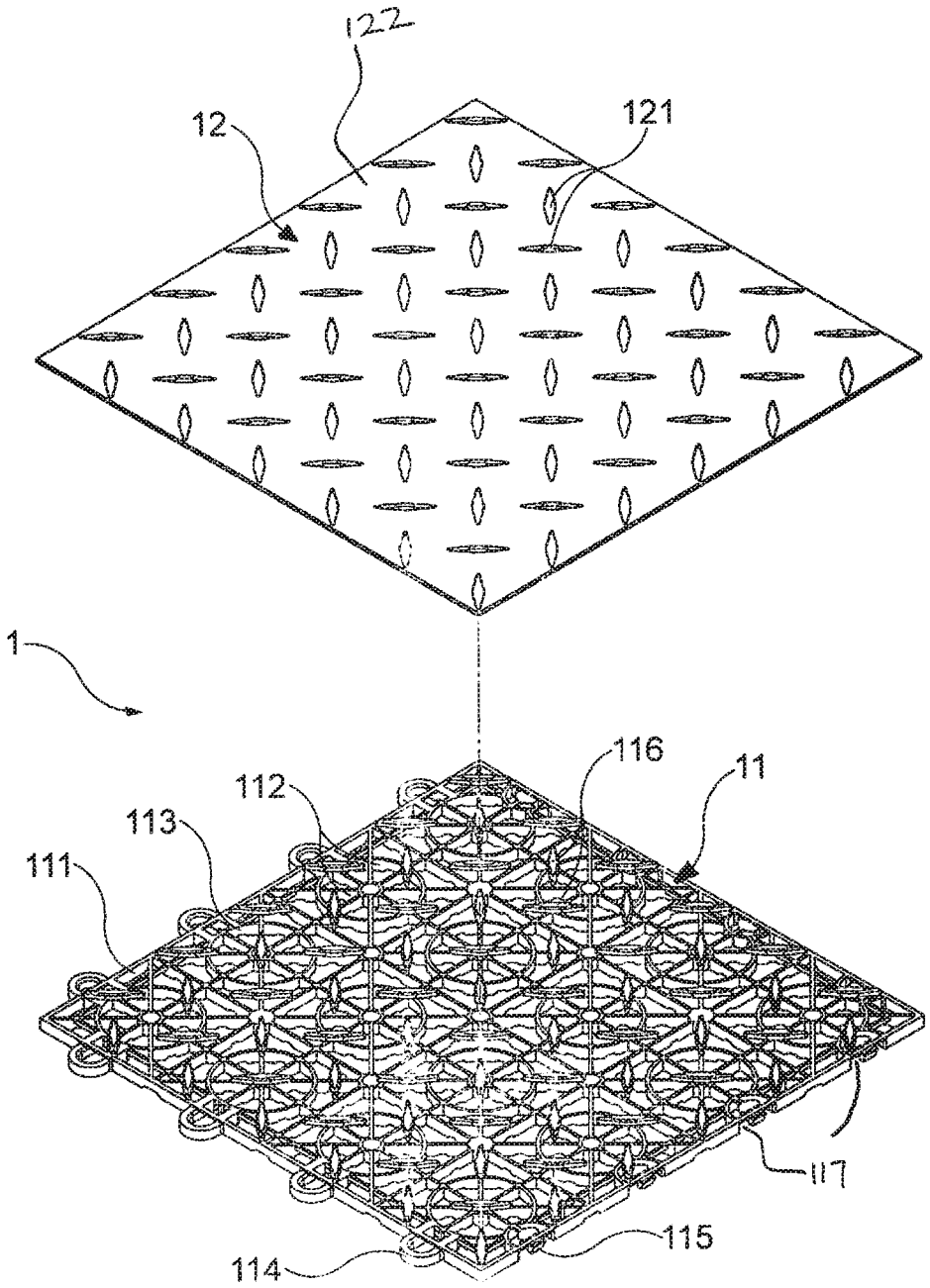
FIG. 2 is an exploded view of the tile depicted in FIG. 1.
Figure 3:
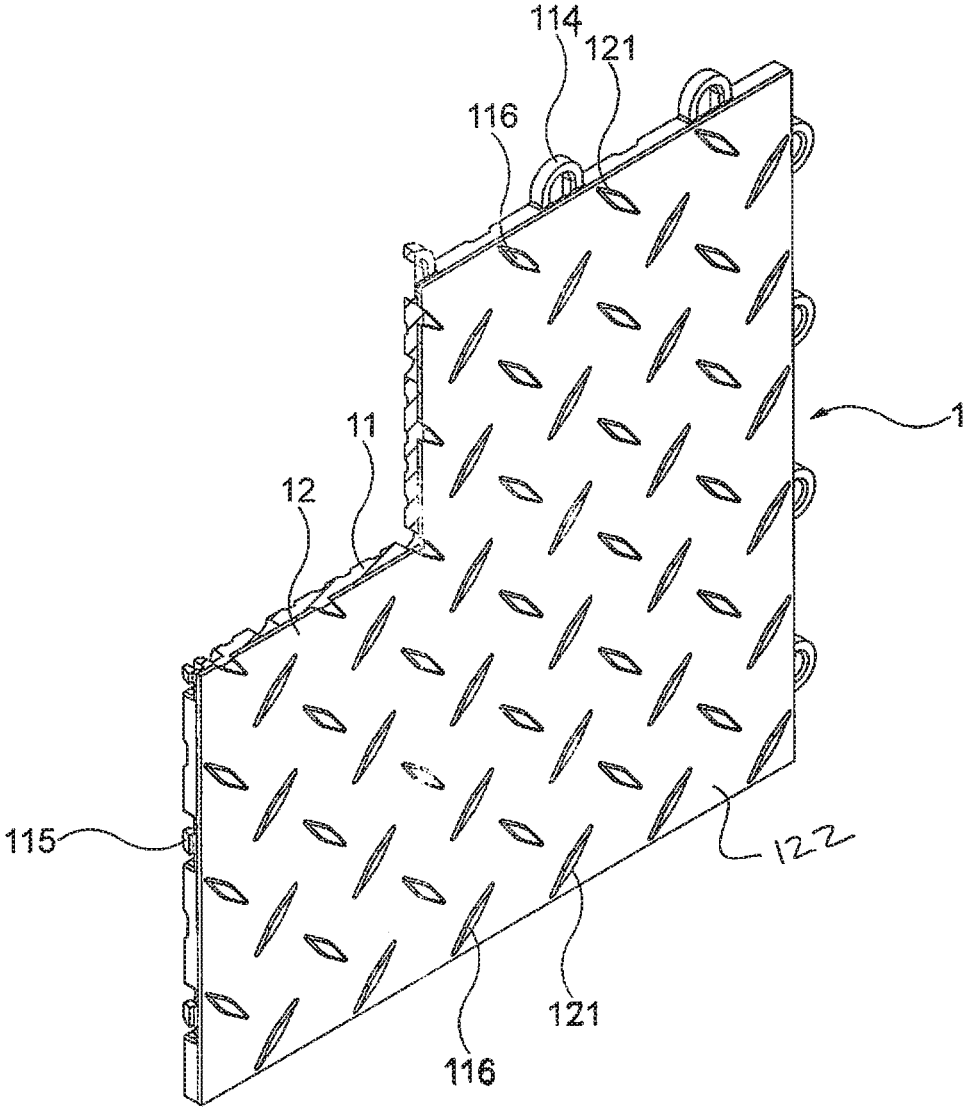
FIG. 3 is a cross-sectional view of the tile depicted in FIG. 1.

Referring initially to FIGS. 1-3, one example embodiment of a two-piece tile 1, exhibiting improvements over the prior art, is disclosed therein. The two-piece tile 1, in this example configuration, comprises a base board 11 and a stepping portion 12. Moreover, in this embodiment, the stepping portion 12 is comprised of a generally planar surface 122 having a plurality of spaced apart apertures 121. Planar surface 122 is configured as a walking or driving surface, in this example, but may have different configurations in different embodiments where the tile is intended for a different end use. Exemplar base board 11, in turn, is configured to pair with stepping portion 12, and includes a plurality of ribs 112 and a plurality of ring ribs 113 longitudinally and latitudinally spaced and distributed between the walls of rectangular frame 111. Such ribs and rings are supplied to provide structural strength and rigidity to the tile in this embodiment, and may be modified, in other embodiments, to provide different structural characteristics as determined by the planned end use.

For enabling assembly of a plurality of tiles to each other to form a floor surface, a plurality of U-shaped engaging rings 114 are provided at two adjacent border edges of rectangular frame 111, each ring serving as a male mating member for engaging with a female mating member (or surface) of an adjacent tile. On the remaining two border edges of example tile 1, a plurality of U-shaped channels 117 are provided as female mating surfaces, each preferably including a riser structure 115 located proximal thereto. Although configured as U-shaped in this embodiment, other configurations of male and female mating members 114 and 117 are of course contemplated. For example, D-shaped or C-shaped structures could be employed, as could structures having additional angles, e.g. square or rectangular shaped members/structures. U-shaped structures have been utilized in this embodiment, however, because the continuous curve, at the terminal ends of the structures, aids in engagement and disengagement of one tile from another. When construing the term U-shaped herein, however, U-shaped should be construed broadly to also include D-shaped and C-shaped, because a D-shape includes a U-shaped member with an additional linear surface, and a C-shaped structure is generally similar to a U-shaped structure but with modestly different proportions.

Figure 5:
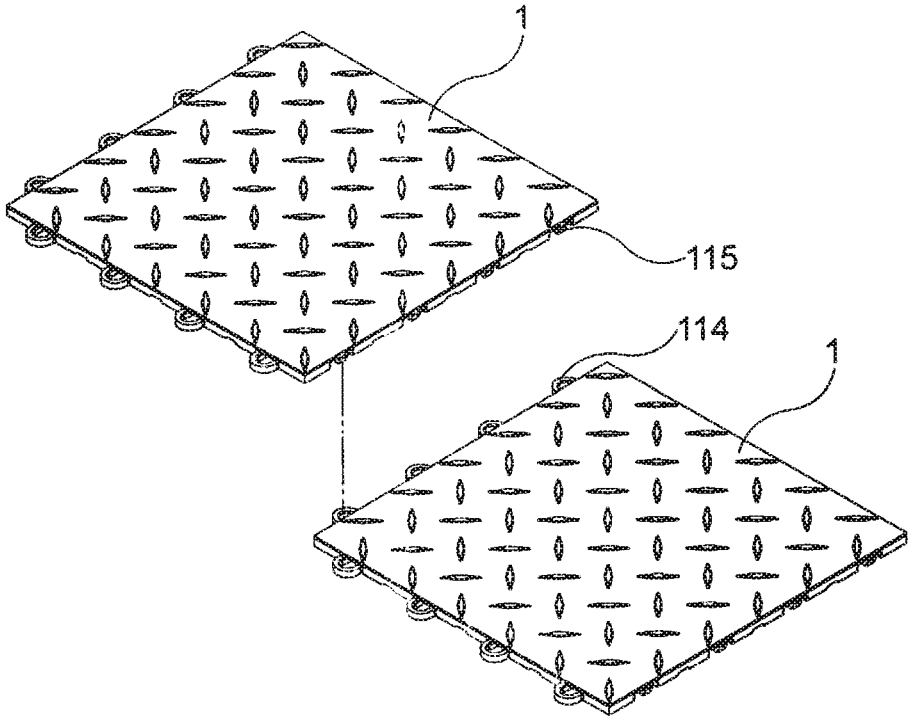
FIGS. 5 and 6 are schematic views showing the assembly of one example tile to another example tile according to one embodiment of the subject invention.
Figure 6:
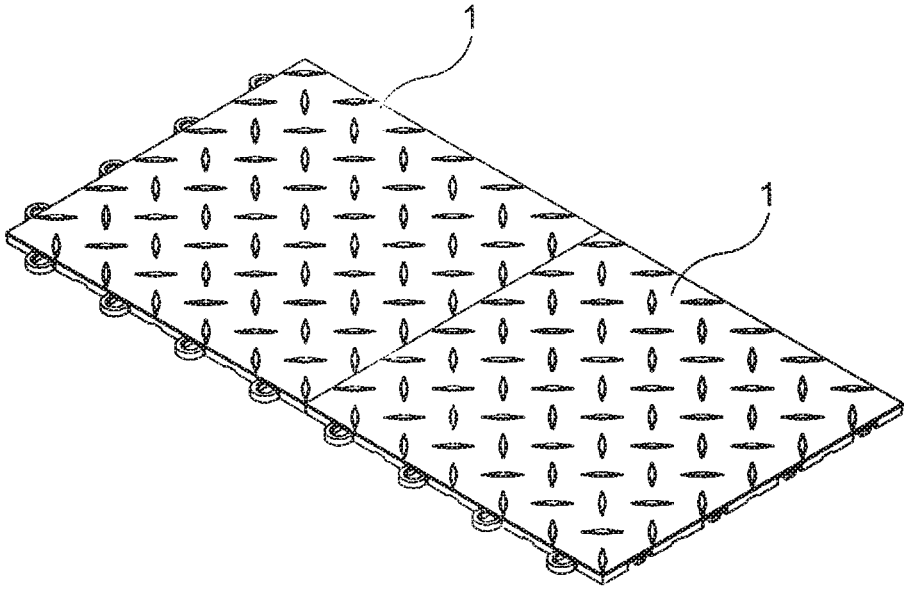

More specifically, in the embodiment illustrated in FIGS. 1-3, the plurality of engaging rings 114 and plurality of U-shaped channels 117 are configured to have complementary shapes and dimensions so that the "male" engaging ring 114 of one tile will assemble structurally to the female U-shaped channel 117 of an adjacent tile (i.e., having the same configuration), and nest therewithin. When tiles are connected as such, such as depicted in FIGS. 5-6, they form a floor surface which can be expanded in size by simply adding additional tiles.

In the example embodiment shown in FIG. 2, the base board 11 also includes a plurality of raised tread elements 116 that are connected to the top surface of the plurality of ribs 112, the plurality of ring ribs 113, and the rectangular frame 111. Such tread elements can be formed as part of base board 11, such as in an injection molding process, or they may be added as additional elements, such as by mechanical connection, adhesive, or material fusion or welding (or similarly suitable) methods. Apertures 121 in stepping portion 12 (i.e., formed in the generally planar surface 122 thereof) are preferably configured spatially and in shape and number to receive, in a nested relation, the plurality of raised tread elements 116 so that when the stepping portion 12 is placed on top of base board 11, stepping portion 12 is held (at least "loosely") in place thereby, because of the mechanical interconnection.

In certain embodiments, stepping board 12 and base board 11 are effectively permanently connected to one another. In such embodiments, although tread elements 116 serve as a mechanical interconnections of such bottom and top tile portions to each other (which can be aided by configuring the treads to have locking structures for locking to stepping board 12), supplemental connection structures and/or methods may be utilized to aid in establishing a more permanent connection. For example, mechanical interlocks can be provided (e.g., at tile border edges or on the provide ribs and rings) and/or adhesives may be used and/or the top and bottom surfaces can be fused together such as with heat welding.

In alternative embodiments, where stepping board 12 and base board 11 are merely temporarily connected, certain functional advantages are provided. For example, if a customer desires a color change of their already installed flooring, such customer can order tile top portion replacements in a different color. By way of more specific example, if a customer already owns an installed red tile floor, such customer can 1) order green tile top portion replacements, 2) remove the existing red top tile portions, 3) and install the green tile top portions to change the color of the floor from blue to yellow. Similarly, if a customer desires a surface texture change of their already installed flooring, such customer can order tile top portion replacements having a different surface texture (e.g., stepping surface). Examples of alternative surface textures grain (e.g., wood grain), treads, channels, cross-hatching, concave or convex regions, surface ornamentation, apertures, drain holes, etc. Still further, if a customer is satisfied with the color and/or surface characteristics of their tile floor, but desire a different base portion, 1) new base tile portions may also be ordered, 2) the existing base tile portions disassembled from the desirable top tile portion, and 3) the replacement base portions installed to the retained desirable top tile portions. Reasons for replacing the bottom/base tile portion could optionally include a need (or desire) for a taller height tile (e.g., by selecting a thicker/taller tile base portion) or a need (or desire) for a stronger or more durable bottom/base tile portion (e.g., such as if moving the tile floor to an automotive garage where the tiles will need to carry thousands of pounds). In yet another example, the bottom tile portion could be replaced because of a need (or desire) for a bottom/base tile portion which has different mechanical characteristics than the existing base tile portion. For example, replacement bases could be ordered which have greater elasticity (e.g., "cushioning") to provide improved walking comfort characteristics to the two-piece tile. In such embodiments, the top tile portion may be selected to be a rigid material—such as a rigid plastic—while the base material is selected to have elastic properties (e.g., thereby obtaining a hybrid two-piece tile configuration). In still other examples, tile base configurations can be selected which include spacing or channels for permitting liquid flow (e.g., while the top tile portion remains raised above the liquid surface), such as for if the tile floor will be installed in areas subject to potential flooding, or other water exposure areas such as showers or bar areas. In these embodiments where stepping board 12 and base board 11 are temporarily connected, the connection of the tile portions is preferably mechanical and can rely on the tread/aperture interconnection alone, or the tread/aperture mechanical connections can be supplemented with additional mechanical connections, such as retaining clips, or locking pins or snap together connectors, formed in one or more of the tile portions.

In the embodiment illustrated, when base board 11 and stepping portion 12 are in an assembled relation, the top surface of one or more of the plurality of raised tread elements 116 extends above the generally planar surface 122 to provide traction for walking or riding or driving. For this purposed, tread elements can be configured to have desirable traction characteristics, in addition to desired ornamental characteristics. Conversely, in other embodiments, tread elements can be positioned flush (e.g., co-planar), or below plane, with (or in relation to) generally planar surface 122, such as in embodiments where the treads are primarily serving an ornamental function.

In at least one example method of manufacturing the tiles described herein, a two-color injection molding machine may be used to form base board 11. In such an embodiment, base board 11 is positioned on a turntable within an injection molding machine, and the turntable of the injection molding machine is rotated, such that the base board 11 and the plurality of raised tread elements 116 are held in position proximal a mold for forming stepping portion 12. Thereafter, while the stepping portion 12 is being molded, the plurality of apertures 121 are formed directly around the structures of the plurality of raised tread elements 116 situated proximal the mold of stepping portion 12. Injection molded using this method, it is ensured that the size, spatial relation, number, and shape of the plurality of apertures 121 substantially matches the tread elements of base board 11, so that the top and bottom tile pieces may be easily assembled and disassembled in matching relation. Alternatively, in other example embodiments, it is also contemplated that this injection molding process can be used to make a two-piece tile 1 wherein the base board 11 and the stepping portion 12 are permanently connected to one another (e.g., such as using the mechanisms or techniques described elsewhere herein).

Figure 4:
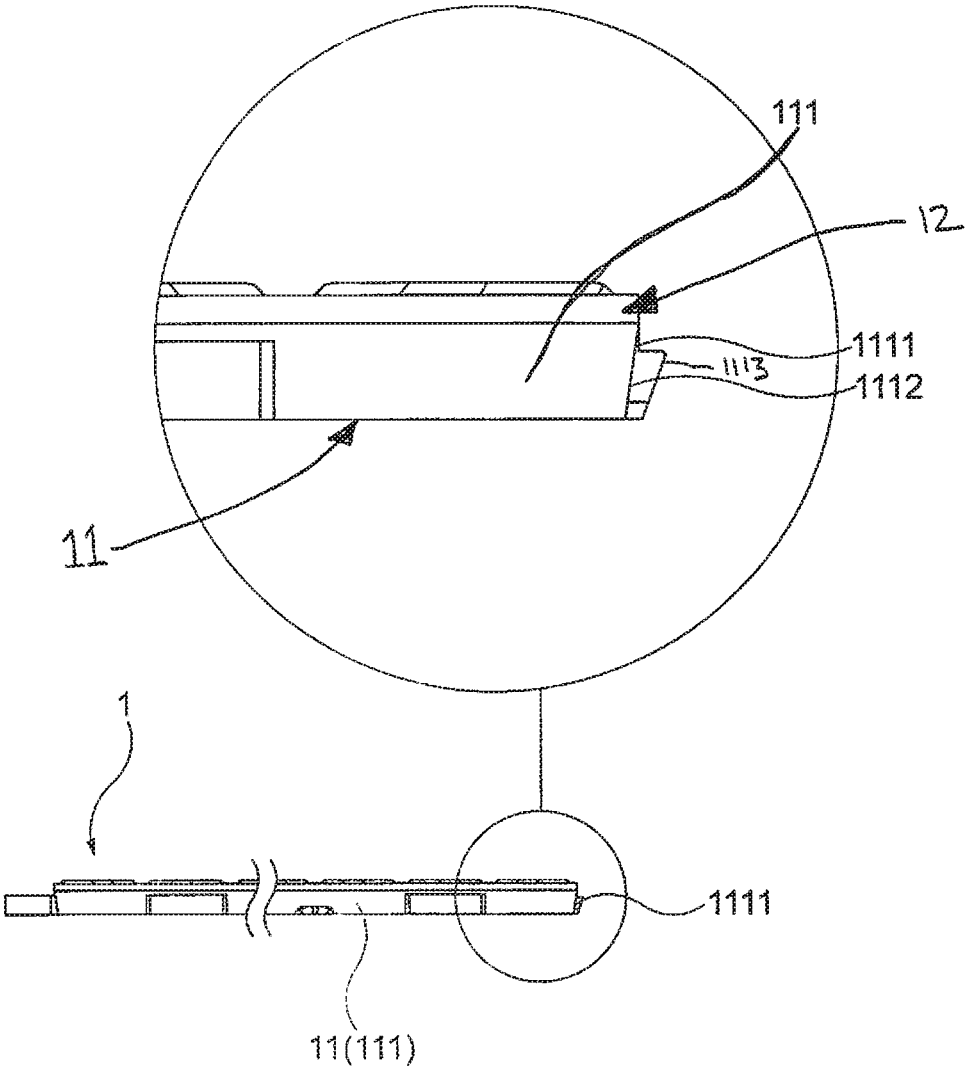
FIG. 4 is a call-out view of an edge of the tile depicted in FIG. 1.
Figure 7:
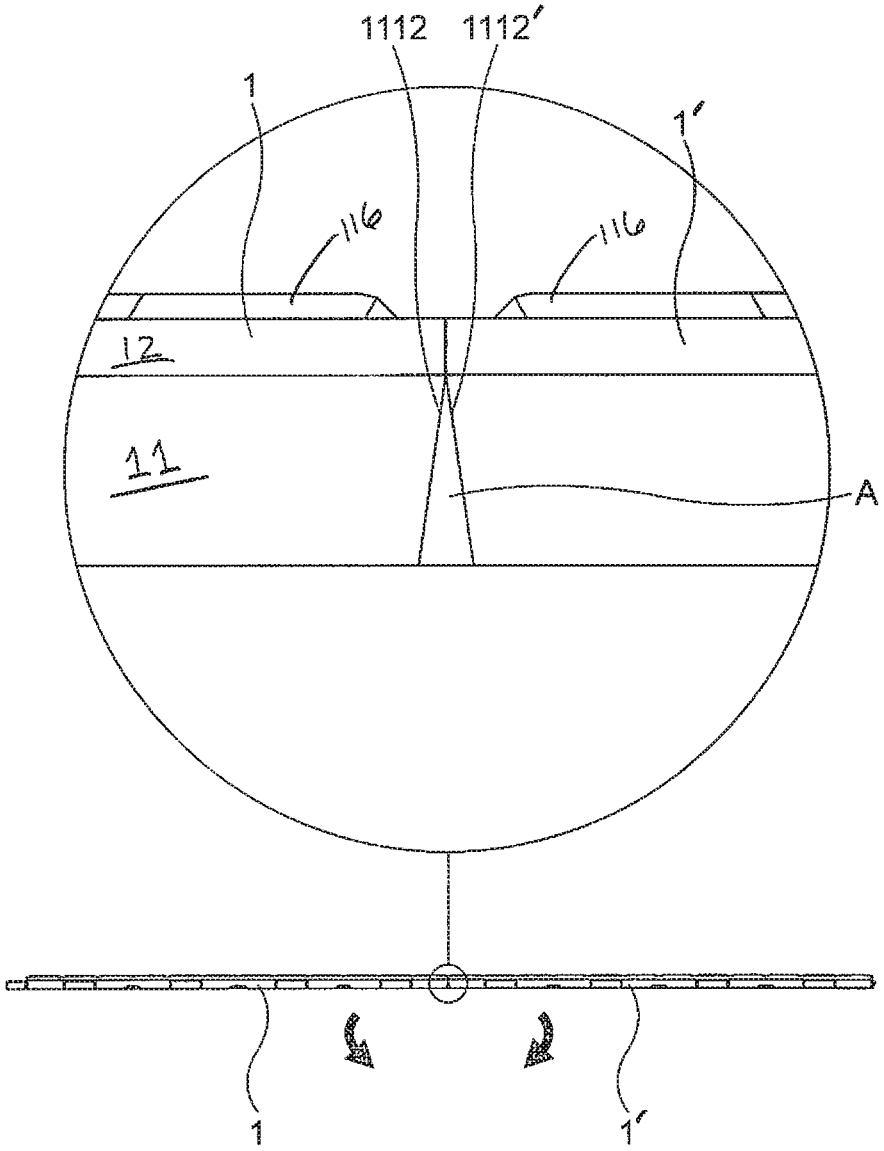
FIG. 7 is a schematic view showing the tiles depicted in FIGS. 5 and 6 being disassembled.
Figure 9:
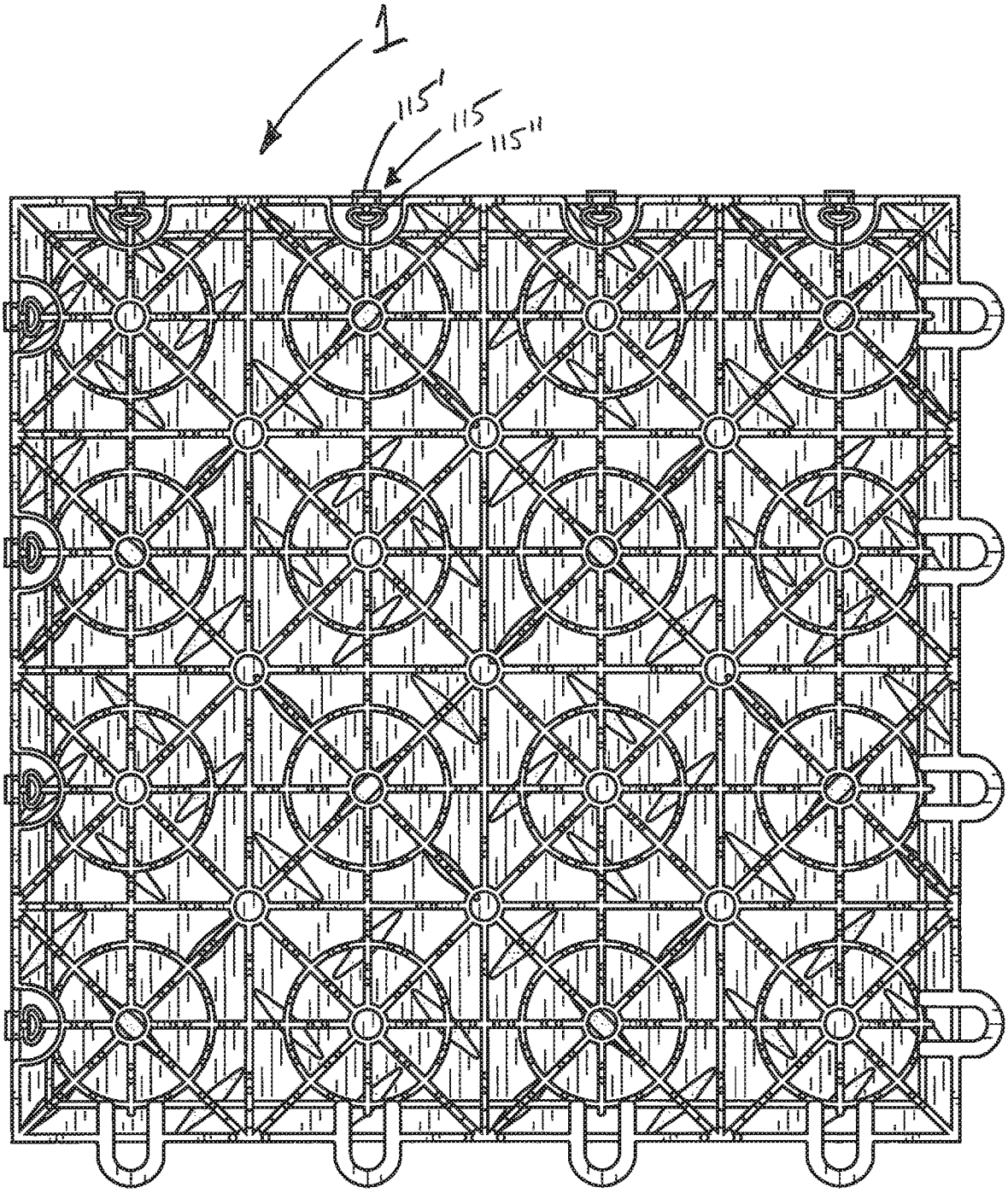
FIG. 9 is an alternative bottom plan view of the tile depicted in FIG. 1.
Figure 10:
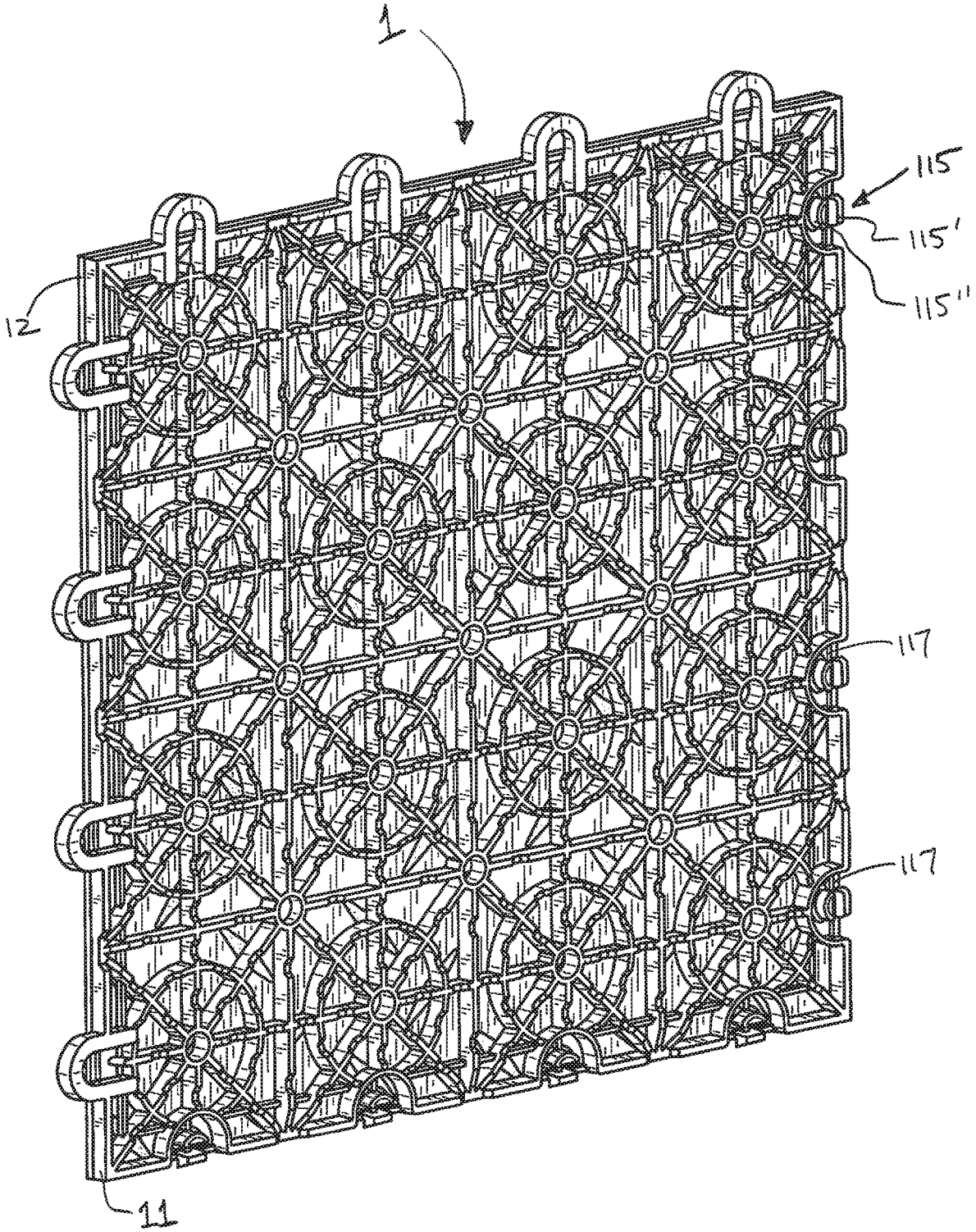
FIG. 10 is an alternative bottom perspective view of the tile depicted in FIG. 1.

Referring now to FIGS. 4 and 7, an enlarged view (i.e., call-out view) of an edge (or border portion) of tile 1 is illustrated therein. In this embodiment, the edge of tile 1 is manufactured to have a beveled (i.e., sloped or angled) planar configuration, shown as beveled surface 1112 in the figure (left side, FIG. 7). A mirror image of tile 1, depicted as tile 1', is also shown in FIG. 4, also having a beveled surface 1112' (right side, FIG. 7, having substantially the same beveled, planar configuration as surface 1112). Utilizing this configuration, when two tiles having the configuration of tile 1 are placed adjacent one another, a gap A is formed between the slopes of beveled surfaces 1112 and 1112' of the respective tiles 1 and 1' (see FIG. 7). Gap A, in this embodiment, is provided for facilitating disassembly of tiles 1 and 1' from one another, by allowing each individual tile to effectively rotate about the tile intersection point towards one another, as indicated by the arrows in FIG. 7. Manipulating the tiles directionally and angularly as such aids in disengaging the connection between the plurality of engaging rings 114 and U-shaped channels 117 on each respective tile. This is particularly useful in embodiments which utilize riser structures 115. For example, because in certain embodiments, such as shown in FIGS. 9-10, riser structure 115 is a two-piece structure comprising an outer riser portion 115' and an inner riser portion 115" each of which is preferably plastically deformable and together having a relative outer diameter (or outer dimension) which slightly exceeds the inner diameter of U-shaped engaging rings 114. Sized and configured as such, and with riser structure 115 located in a central region of U-shaped channels 117, when a U-shaped engaging ring is inserted into a U-shaped channel, riser structure 115 is force fit into the center aperture of the U-shaped engaging ring, slightly temporarily biasing riser portion 115' and 115" towards each other (effectively deforming riser structure 115 by pushing its two component parts closer together). Increased bias is supplied at the beginning of the engagement by providing a tip extension 1113 on at least one portion of the riser structure, so that the tip has an effective diameter greater than the diameter of the body 1111 of the riser structure. Consequently, once a U-shaped engaging ring 114 is force fit over a riser structure tip, riser portions 115' and 115" return to their static positions (prior to deformation) but while frictionally engaging at least one interior surface of the U-shaped engaging ring. Further aiding retaining the tile-to-tile connection, tip extension 1113 (see FIG. 4) structurally blocks U-shaped engaging ring 114 from being accidentally disengaged from U-shaped channel 117 (within which it has nested). In short, because of the unique mechanical tile-to-tile connection described herein, beveled surfaces 1112 and 1112', and the gap A therebetween, greatly aid in disassembling one tile from another once connected. Similarly, in the reverse operation, the supplying of structural gap A assists in manipulating and orienting U-shaped engaging rings and U-shaped channels, of adjacent tiles 1 and 1', sufficiently close and in proper relation to each other, so that they can be snapped together to form a tile-to-tile connection.

In embodiments where tiles 1 (and/or 1') are comprised of fragile materials, the force required to assemble or disassemble tiles to and from each other could cause cracking, thereby ruining one or more of the tiles for repeated use. In the (optional) embodiment disclosed in FIGS. 4 and 7, however, these issues are overcome by providing the gap A, which reduces the amount of force required for assembling or disassembling the two-piece tiles. Further, this configuration can even prevent cracking of the engaging rings 114 (or other tile parts), thus allowing each two-piece tile 1 to be used repeatedly.

Figure 8:
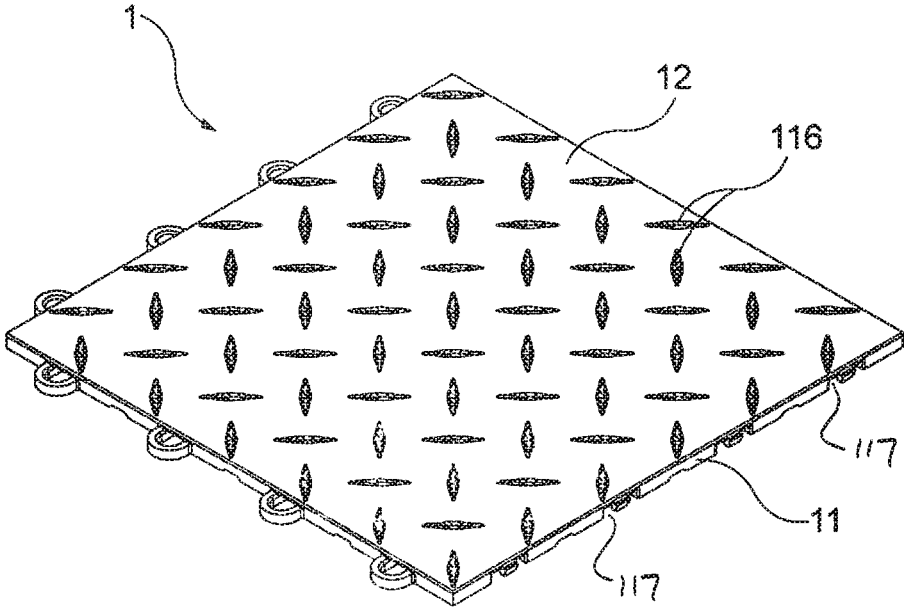
FIG. 8 is an alternative perspective view of the tile depicted in FIG. 1.

In an alternative (optional) embodiment the base board 11 and the stepping portion 12 can be made of the same material or different materials, or the same color or different colors, so that the plastic floor provides different functions or different visual effects. For example, the material used to form the base board 11, or the plurality of raised tread elements 116, may be one color and the material used to form the stepping portion 12, may be formed from another color. In this fashion when the two-piece tile 1 is assembled, a color contrast is supplied between the rectangular frame 111 and the stepping portion 12, or between the stepping portion 12 and the plurality of raised tread elements 116. Or, as shown in FIG. 8, the base board 11 and the stepping portion 12 can be made of different materials. FIG. 8 provides a two-piece tile 1 wherein the plurality of raised tread elements 116 of the base board 11 are made of an anti-slip material which is different than the material used to form the stepping portion 12.

Figure 11:
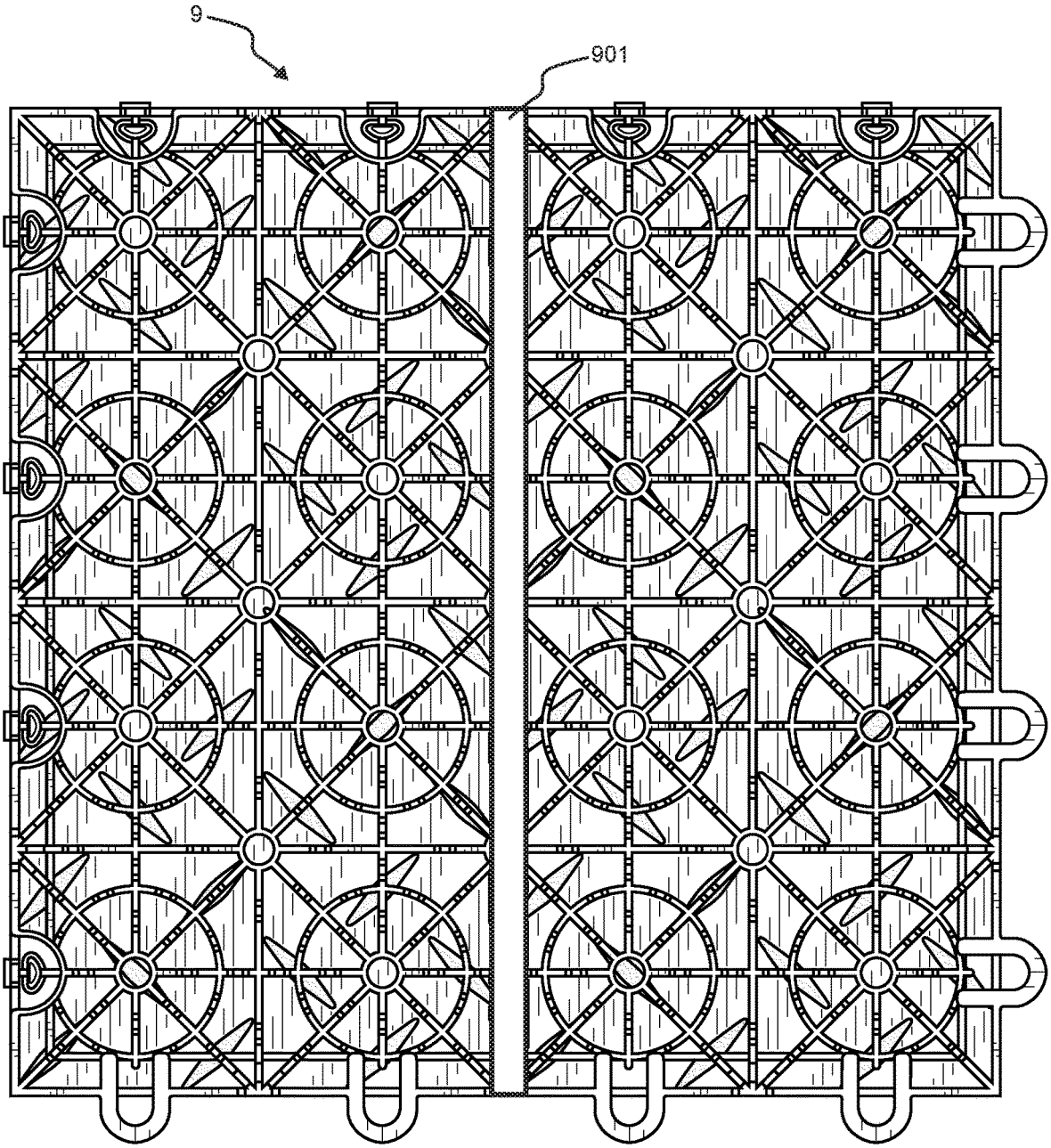
FIG. 11 is an alternative bottom view of the tile depicted in FIG. 1 with a single channel.
Figure 12:
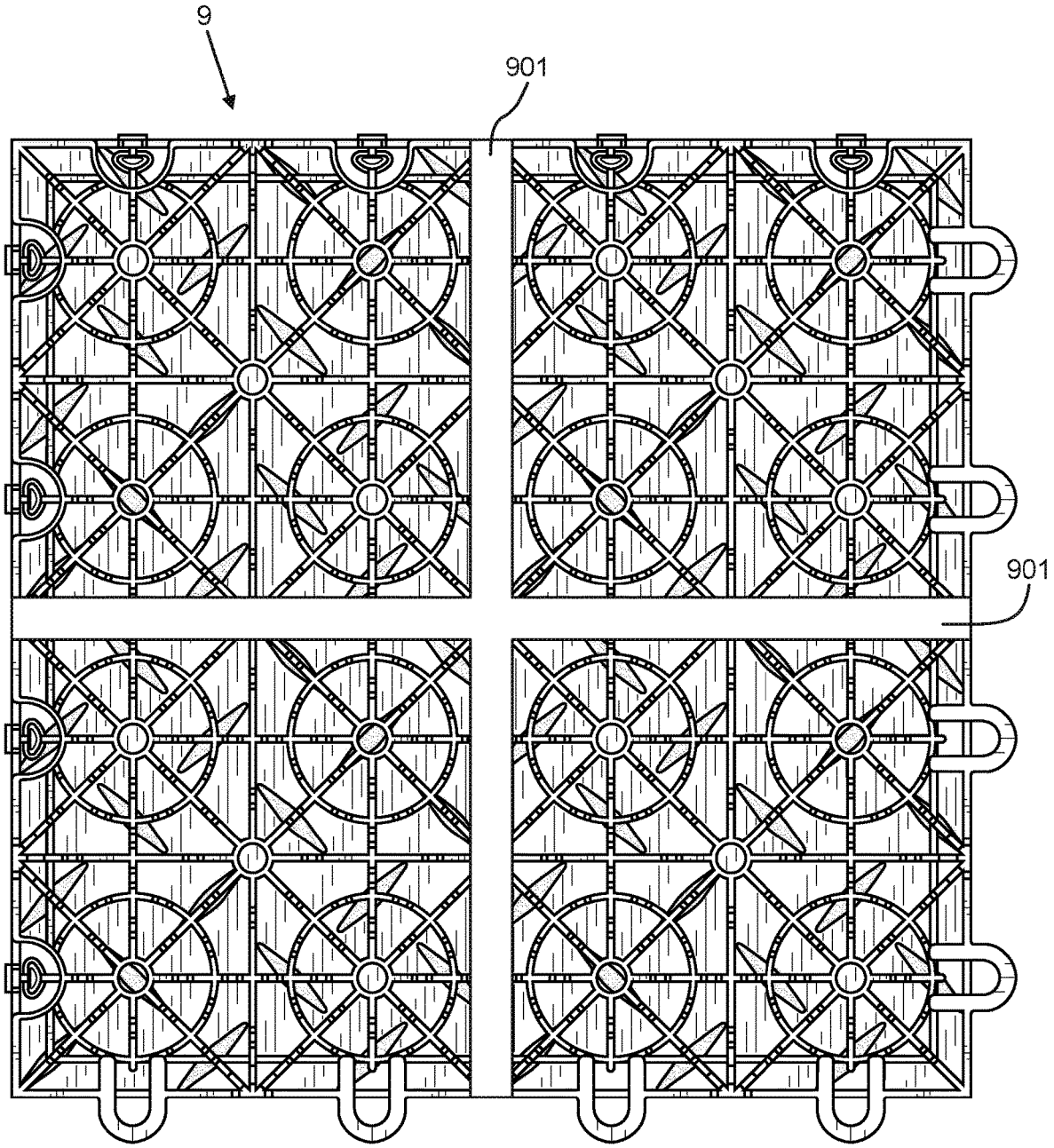
FIG. 12 is an alternative bottom view of the tile depicted in FIG. 1 with intersecting channels.

Referring now to FIGS. 11-12, in yet another alternative embodiment there is provided a two-piece tile 9 that includes at least one channel 901. In this configuration when one or more two-piece tiles 9 are assembled the channel 901 in one tile may be aligned with the channel 901 in an adjacent tile to provide a continuous channel, which will be useful for the routing of wires or other utilities underneath the modular floor. Although it is contemplated that the two-piece tile could include one or more channels in various configurations, FIG. 11 depicts one embodiment with a single channel. FIG. 12 illustrates an alternative view configured with intersecting channels so that adjoining mats will have a matching channel to align with no matter the orientation of the adjacent tiles.

Once given the above disclosure, many other features, modifications, and improvements will become apparent to the skilled artisan. Such features, modifications, and improvements are therefore considered to be part of this invention, without limitation imposed by the example embodiments described herein. Moreover, any word, term, phrase, feature, example, embodiment, or part or combination thereof, as used to describe or exemplify embodiments herein, unless unequivocally set forth as expressly uniquely defined or otherwise unequivocally set forth as limiting, is not intended to impart a narrowing scope to the invention in contravention of the ordinary meaning of the claim terms by which the scope of the patent property rights shall otherwise be determined.

What is claimed is:

1. A two-piece tile comprising:

a base tile portion having a plurality of structurally supportive skeletal members distributed between walls of a frame, said plurality of structurally supportive skeletal members and said frame collectively comprising a skeletal base structure;

a plurality of male interlocking members extending from at least one edge of said frame of said skeletal base structure;

a plurality of female interlocking receptacles located along at least one edge of said frame of said skeletal base structure for receiving male interlocking members of a different, adjacently located two-piece tile;

a plurality of tread elements located and distributed atop one or more surfaces of said skeletal base structure;

a top generally planar tile portion having a plurality of apertures which are so sized and spaced so as to match the respective size and spacing pattern of said plurality of tread elements of said base tile portion, such that said top generally planar tile portion assembles to, and is assembled to, said base tile portion with said plurality of tread elements nested in said plurality of apertures; and wherein, when said top generally planar tile portion is assembled to said base tile portion, said plurality of tread elements at least partially extend above a planar surface of said top generally planar tile portion thereby providing an anti-slip surface.

2. The two-piece tile according to claim 1 wherein said base tile portion is formed from a material having a first color, and said top generally planar tile portion is formed from a material having a second color which is different from said first color.

3. The two-piece tile according to claim 2 wherein said plurality of tread elements are formed from a material having the same color as said first color of said material forming said base tile portion.

4. The two-piece tile according to claim 3 wherein said base tile portion and said top generally planar tile portion are each formed from an injection molding procedure.

5. The two-piece tile according to claim 3 wherein said top generally planar tile portion is removably connected to said base tile portion.

6. The two-piece tile according to claim 5 wherein because said top generally planar tile portion is removably connected to said base tile portion, said top generally planar tile portion can be replaced independently of said base tile portion to repair said two-piece tile or to change the color appearance of said two-piece tile.

7. The two-piece tile according to claim 1 wherein said base tile portion is formed from a first material, and said top generally planar tile portion is formed from a second material which is different from said first material.

8. The two-piece tile according to claim 1 wherein said top generally planar tile portion is formed from a first material, and wherein said plurality of tread elements are formed from a second material which is different from said first material.

9. The two-piece tile according to claim 8 wherein said base portion is formed from a material which is different than said second material from which said plurality of tread elements are formed.

10. The two-piece tile according to claim 1 wherein said skeletal base structure comprises a plurality of ribs and rings having empty spaces therebetween.

11. The two-piece tile according to claim 10 wherein said plurality of tread elements are located atop said plurality of ribs and rings.

12. The two-piece tile according to claim 1, wherein said two-piece tile includes at least one substantially linear edge for abutting with an adjacent two-piece tile, when assembled together to said adjacent two-piece tile, said substantially linear edge including at least one beveled edge, for aligning with an adjacent beveled edge, to form an interstitial space between assembled together adjoining two-piece tiles such that assembly and disassembly of adjoining two-piece tiles to one another is aided by permitting improved angular manipulation of said adjoining two-piece tiles, one with respect to the other.

13. The two-piece tile according to claim 1 wherein said base tile portion includes at least one channel configured to align with at least one channel of an adjacent two-piece tile, when assembled together to said adjacent two-piece tile, said aligned channels being useful to allow routing of one or more wires underneath said top generally planar tile portion.

14. A two-piece tile comprising:

a base tile portion having a plurality of structurally supportive skeletal members distributed between walls of a frame, said plurality of structurally supportive skeletal members and said frame collectively comprising a skeletal base structure;

a plurality of male interlocking members extending from at least one edge of said frame of said skeletal base structure;

a plurality of female interlocking receptacles located along at least one edge of said frame of said skeletal base structure for receiving male interlocking members of a different, adjacently located two-piece tile;

a plurality of tread elements located and distributed atop one or more surfaces of said skeletal base structure;

a top generally planar tile portion having a plurality of apertures which are so sized and spaced so as to match the respective size and spacing pattern of said plurality of tread elements of said base tile portion, such that said top generally planar tile portion assembles to, and is assembled to, said base tile portion with said plurality of tread elements nested in said plurality of apertures;

wherein said plurality of male interlocking members comprise substantially U-shaped structures; and wherein said plurality of female interlocking receptacles comprise substantially U-shaped channels configured in shape and size to fit said substantially U-shaped structures, of adjacent two-piece tiles, nested therein;

and further including a plurality of deformable riser members located proximal openings of said plurality of substantially U-shaped channels, each said deformable riser member being configured to lock a said substantially U-shaped structure within a said substantially U-shaped channel by friction or physical interference engagement with a surface of an adjacent two-piece tile;

wherein said base tile portion has a configuration which is generally rectangular in outline and is also generally planar; and wherein said plurality of tread elements are configured to have anti-slip properties and wherein, when said top generally planar tile portion is assembled to said base tile portion, said plurality of tread elements at least partially extend above a planar surface of said top generally planar tile portion.

15. A modular plastic floor comprising a plurality of two-piece tiles assembled to one another, each said two-piece tile comprising:

a base tile portion having a plurality of structurally supportive skeletal members distributed between walls of a frame, said plurality of structurally supportive skeletal members and said frame collectively comprising a skeletal base structure;

a plurality of male interlocking members extending from at least one edge of said frame of said skeletal base structure;

a plurality of female interlocking receptacles located along at least one edge of said frame of said skeletal base structure for receiving male interlocking members of a different, adjacently located two-piece tile;

a plurality of tread elements located and distributed atop one or more surfaces of said skeletal base structure; and a top generally planar tile portion having a plurality of apertures which are so sized and spaced so as to match the respective size and spacing pattern of said plurality of tread elements of said base tile portion, such that said top generally planar tile portion assembles to, and is assembled to, said base tile portion with said plurality of tread elements nested in said plurality of apertures; and wherein, when said top generally planar tile portion is assembled to said base tile portion, said plurality of tread elements at least partially extend above a planar surface of said top generally planar tile portion thereby providing an anti-slip surface.

16. A method of making a two-piece tile comprising:

forming a base tile portion having a plurality of structurally supportive skeletal members distributed between walls of a frame, said plurality of structurally supportive skeletal members and said frame collectively comprising a skeletal base structure;

forming a plurality of male interlocking members extending from at least one edge of said frame of said skeletal base structure;

forming a plurality of female interlocking receptacles located along at least one edge of said frame of said skeletal base structure for receiving male interlocking members of a different, adjacently located two-piece tile;

forming a plurality of tread elements and locating said plurality of tread elements atop one or more surfaces of said skeletal base structure;

forming a top generally planar tile portion having a plurality of apertures which are so sized and spaced so as to match the respective size and spacing pattern of said plurality of tread elements of said base tile portion, such that said top generally planar tile portion assembles to, and is assembled to, to said base tile portion with said plurality of tread elements nested in said plurality of apertures;

connecting said top generally planar tile portion to said base tile portion; and wherein, when said top generally planar tile portion is assembled to said base tile portion, said plurality of tread elements at least partially extend above a planar surface of said top generally planar tile portion thereby providing an anti-slip surface.

17. The method of making a two-piece tile according to claim 16, further comprising:

forming said base tile portion to have a first color; and forming said top generally planar tile portion to have a second color different than said first color.

18. The method of making a two-piece tile according to claim 17, further comprising:

forming a plurality of said base tile portions having said first color, and storing said formed base tile portions pending customer orders for a customer specified two-piece tile color;

upon receipt of said customer orders, forming one or more of said top generally planar tile portions to have a second color which matches said customer specified two-piece tile color; and connecting said one or more top generally planar tile portions to one or more of said base tile portions, to form a tile having the color specifications of said customer specified two-piece tile color.

19. The method of making a two-piece tile according to claim 16, further comprising:

forming said base tile portion to have a first color;

forming said top generally planar tile portion to have a second color;

temporarily, removeable connecting said top generally planar tile portion to said base tile portion such that said top generally planar tile portion can be replaced independently of said base tile portion to change the color appearance of said two-piece tile by replacing the original said top generally planar tile portion with a replacement top generally planar tile portion having a third color which is different from said second color.

20. The method of making a two-piece tile according to claim 16, further comprising:

forming said base tile portion out of a first material; and forming said top generally planar tile portion out of a second material which is different than said first material.

21. The method of making a two-piece tile according to claim 20, further comprising:

forming a plurality of said base tile portions from said first material, and storing said formed base tile portions pending customer orders for a customer specified two-piece tile material configuration;

upon receipt of said customer orders, forming one or more of said top generally planar tile portions to have a second material which matches said customer specified two-piece tile material configuration; and connecting said one or more top generally planar tile portions to one or more of said base tile portions, to form a tile having the material configuration of said customer specified two-piece tile material configuration.

22. The method of making a two-piece tile according to claim 16, further comprising:

determining a weight bearing strength parameter; and forming said base tile portions to meet or exceed said weight bearing strength parameter by configuring said skeletal base structure to meet or exceed said weight bearing strength parameter.

23. The method of making a two-piece tile according to claim 16, further comprising:

determining a two-piece tile height parameter; and configuring a height of said base tile portion such that said two-piece tile height meets said two-piece tile height parameter, when said top generally planar tile portion is connected to said base tile portion.

24. The method of making a two-piece tile according to claim 16 wherein said top generally planar tile portion and said base tile portion are each injection molded.

25. The method of making a two-piece tile according to claim 24 wherein said top generally planar tile portion and said base tile portion are integrally formed utilizing a two-color injection molding step.

* * * * *